United States Patent [19]

Lavanchy

[11] 4,245,777

[45] Jan. 20, 1981

[54] CENTRIFUGE APPARATUS

[75] Inventor: Andre C. Lavanchy, Devon, Pa.

[73] Assignee: Pennwalt Corporation, Philadelphia, Pa.

[21] Appl. No.: 70,946

[22] Filed: Aug. 30, 1979

[51] Int. Cl.[3] ..... B04B 1/20

[52] U.S. Cl. ..... 233/7

[58] Field of Search ..... 233/7, 1 R, 3, 27, 28, 233/40, 44, 41, 42, 43, 46, 47 R, 14 R

[56] References Cited

U.S. PATENT DOCUMENTS

| | | | |
|---|---|---|---|
| 3,428,246 | 2/1969 | Finkelston | 233/7 |
| 3,795,361 | 3/1974 | Lee | 233/7 |
| 3,885,734 | 5/1975 | Lee | 233/7 X |
| 3,934,792 | 1/1976 | High et al. | 233/7 |
| 4,142,669 | 3/1979 | Burlet | 233/7 |

*Primary Examiner*—Stanley N. Gilreath

*Attorney, Agent, or Firm*—Edward A. Sager

[57] ABSTRACT

In a decanter centrifuge having the heavy phase discharge weir a greater radial distance from the bowl axis than the light phase weir, a slender feed cone is provided to minimize turbulence from feed entering for separation and the baffle is of annular construction mounted on the feed cone. The baffle is made in sections which overlap circumferentially to prevent liquid flow in axial direction, and which also adjustably overlap in radial direction in order to permit selective adjustment of its outside diameter.

10 Claims, 6 Drawing Figures

CENTRIFUGE APPARATUS

BACKGROUND OF THE INVENTION

Decanter centrifuges include a rotating bowl in which a screw conveyor revolves at a slightly different speed.

Such centrifuges continuously receive and separate feed into layers of light and heavy phase materials which are discharged separately from the bowl. The screw conveyor moves the heavy phase material to a discharge port in a conical end portion of the bowl.

It is known from U.S. Pat. No. 3,795,361, assigned to the assignee of the present invention, that decanter centrifuges do not readily separate two materials of similar specific gravity, or if the heavy phase material is very slippery. Also, light and heavy phases having nearly the same specific gravity tend to re-mix when disturbed by the splashing introduction of feed or other turbulence.

U.S. Pat. No. 3,795,361 discloses centrifuge apparatus for efficient separation of feed mixtures which heretofore have defied separation. In such centrifuge apparatus, the weir surface of the heavy phase discharge port is at a greater radial distance from the bowl axis than is the weir surface of the light phase discharge port. In addition, a flat annular baffle and a feed cone is provided, both mounted coaxially on the hub of the screw conveyor for movement therewith.

The baffle of U.S. Pat. No. 3,795,361 is disposed normal to the bowl axis, preferably in position to partition the interior of the bowl into a separating zone and a discharge zone. The separating zone is surrounded by the cylindrical portion of the bowl; and the discharge zone is surrounded by the tapered end portion of the bowl. Being closely spaced from the inner surface of the bowl, the baffle defines a restricted annular passageway for the underflow of heavy phase material from the separating zone to the discharge zone. The flow area of this passageway is sufficiently large to prevent heavy phase material from accumulating in the separation zone, and desirably not larger than the solids discharge port. The baffle extends outwardly from the bowl axis beyond the interface between the separated phases in order to prevent the flow of light phase layer from the separating zone to the discharge zone.

The present invention is an improvement of the centrifuge construction disclosed in U.S. Pat. No. 3,795,361 and divisional U.S. Pat. No. 3,885,734, incorporated herein by reference, in that it seeks to further reduce turbulence and to present less restriction to the flow of heavy phase material through the space between the feed cone and the bowl, while retaining the improved separating efficiency for materials of similar specific gravity and slippery, fine solids. Furthermore, the present invention seeks to provide a screw conveyor which has a feed cone for admitting feed to the separating zone with minimum turbulence, and which also has a baffle that lends itself to easy change of its outside diameter. With an easy change of baffle outside diameter, the centrifuge may be adapted to changes of feed flow rate, solids concentration, and solids characteristics, whereby separation efficiency may be maximized.

BRIEF DESCRIPTION OF THE INVENTION

The present invention provides a screw conveyor for a centrifuge of the type set forth, wherein a conical feed cone is combined with a flat annular baffle mounted on the feed cone. The advantages of doing so are that turbulence is minimized by receiving feed through a feed cone having accelerator vanes; and by not having the feed cone submerged in the materials in the separating zone, as is the case with the conical baffle of the prior art, no turbulence by stirring takes place. Yet, the baffling that is necessary for centrifuges of this type is provided by the annular baffle mounted on the feed cone. Such an annular baffle is easily machined to the desired outside diameter and it leaves the discharging zone unconfined whereby separated heavy phase material may flow easily therethrough.

The slender feed cone and flat annular baffle may be welded to one another and the screw flights coiled about them to form a strong assembly.

As a modification, the annular baffle is made in sections which overlap in radial and circumferential direction, thus providing adjustability to its desired outside diameter without loss of seal against axial flow through the baffle.

DESCRIPTION OF THE PREFERRED EMBODIMENT

Figure 3:
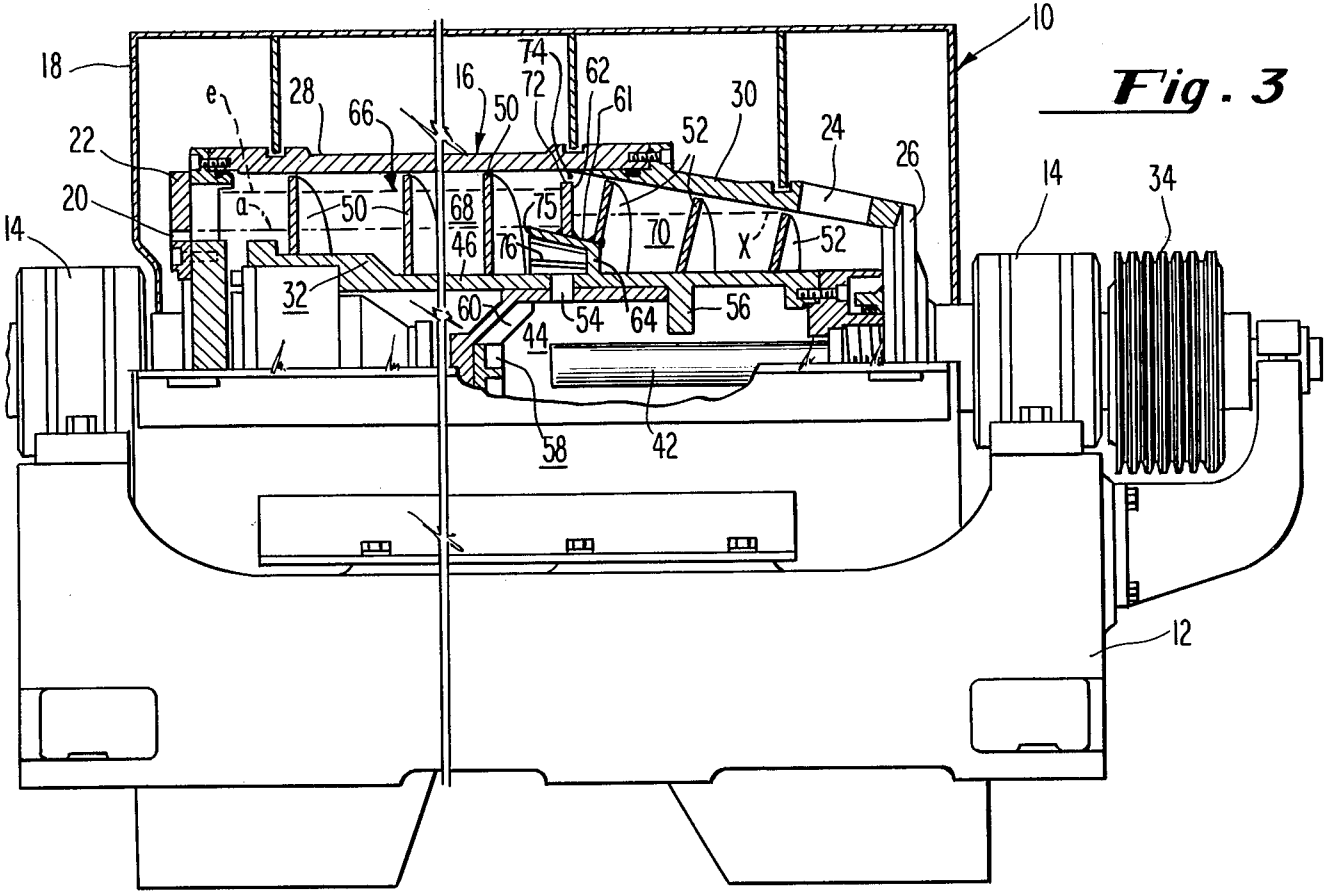
FIG. 3 is an elevational view, partly in section, of a decanter centrifuge incorporating the screw conveyor of FIG. 1.

Shown in FIG. 3 is a centrifuge 10 comprising a frame 12 having main bearings 14 in which are journaled the ends of a hollow, elongated centrifuge bowl 16 of circular cross section. The bowl 16 is adapted for rotation about its longitudinal axis within a housing 18.

A plurality of discharge ports 20 are formed in one end wall 22 of the bowl 16 and annularly disposed about the rotational axis for the discharge of liquid, or light phase, material. A plurality of similarly disposed solids or heavy phase discharge ports 24 are provided adjacent the other end wall 26. The peripheral wall of the bowl 16 is otherwise of imperforate tubular construction, a major portion 28 thereof being cylindrical.

A conical or tapered portion 30 of the bowl 16 adjacent the end wall 26 gradually decreases in diameter from the cylindrical portion 28 toward and beyond the solid discharge openings 24. The radial distance from the bowl axis of the liquid discharge ports 20, and also that of the heavy phase discharge ports 24, is preselected to position the inner surface of the light phase material at level which is radially inward of the level of the weir surfaces of the heavy phase discharge ports 24.

Mounted coaxially of the bowl 16 in suitable bearings is a screw conveyor 32. The bowl 16 is rotated relative to the screw conveyor by connection through a pulley 34 to suitable drive means, such as a motor (not shown).

The bowl 16 and the conveyor 32 are rotated at slightly different speeds by such suitable means (not shown) as a gear box having torque control means, and a spline shaft within the bowl shaft connected to the conveyor 32.

The feed mixture to be separated is delivered to the interior of the centrifuge through a stationary feed tube 42. The latter projects in axial direction and terminates concentrically of a feed chamber 44 within a hub 46.

The hub 46, which is part of the conveyor 32, carries outwardly projecting, conically coiled screw flights 52. The flights 50, 52 have small clearance from the bowl 16 and are mounted for rotation with the hub 46 relative to the bowl 16, at a speed suitably different from the speed of the bowl to move separated heavy phase material toward the discharge openings 24 for discharge therethrough. The hub 46 is further provided with one or more feed passages 54 for passing the feed from the feed chamber 44 to a separation zone within the bowl 16.

The feed chamber 44 extends within the hub in axial direction from a partition ring 56 to an accelerator 58, the latter including a vane assembly 60 for imparting radial and tangential velocity to the feed mixture.

A broken line a designates the maximum and desired level of material within the cylindrical portion 28 of the rotating bowl 16 which is maintained by the discharge ports 20. The outermost portion of the surface defining each port 20 acts as an overflow lip or weir over which light phase material flows when discharged from the bowl 16.

Figure 1:
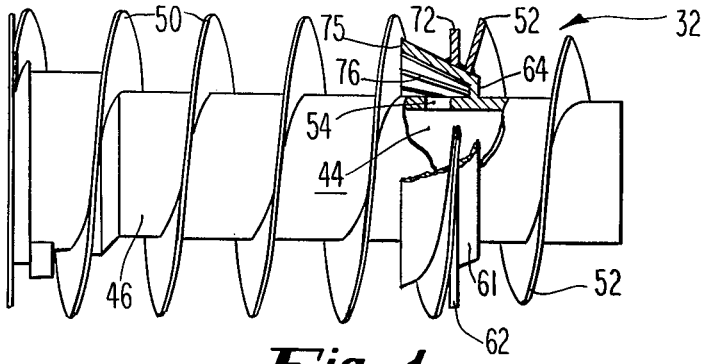
FIG. 1 is an elevational view, partly in section, of a centrifuge screw conveyor embodying the invention.

As shown in FIG. 3, the coiled flights 52 are welded to the outer surface of a feed cone 61 of frustoconical shape. The feed cone 61 tapers in the same direction as the conically tapered end portion 30 of the bowl 16 with its larger end open and facing the light phase discharge ports 20. The smaller, closed end 64 of the feed cone 61 is securely attached to the hub 46, with the feed cone positioned radially outward of the feed outlet 54. The coiled flights 52 are structurally connected between the outer surface of the larger end of the feed cone 61 and the hub 46. Reference is made to FIG. 1 for an illustration of the latter.

Since the helical flights 50, 52 of the screw conveyor are adapted to the contour of the bowl 16, extending to the corresponding inner surface portions of the bowl, an elongated chamber 66 is helically formed about the hub 46, being wound between the flights 50, 52 and disposed within the bowl 16.

A flat annular baffle 62 is rigidly and coaxially mounted on the feed cone 61, adjacent to the junction of the cylindrical portion 28 and the conical portion 30 of the bowl 16.

The baffle 62 is positioned within the bowl 16 to divide the helical chamber 66 into two axially adjacent zones, a separating zone 68 and a discharging zone 70. The discharging zone 70 is surrounded by the tapered portion 30 of the bowl 16. The discharging zone 70 extends in axial direction from the baffle 62 to the end wall 26, although for all practical purposes the zone 70 terminates with the discharge ports 24 for heavy phase material. The ports 24 communicate with the discharging zone 70.

The separating zone 68 lies outwardly of the hub 46 and extends from the baffle 62 to the end wall 22, terminating in the discharge ports 20 for light phase material. The cylindrical portion 28 of the bowl 16 surrounds the separating zone 68. The ports 20 communicate with the separating zone 68.

Feed entering the separating zone 68 within the rotating bowl 16 is subjected to high centrifugal forces which are usually 2000 to 4000 times gravitational force. This separates the mixture of light and heavy phase material and an outer layer of heavy phase material. The annular interface between the two layers in zone 68 is shown by a broken line designated e. The layer of heavy phase material lies outwardly of the e line; and the layer of light phase material lies inwardly of the e line. The inner surface of the light phase layer is approximately in axial alignment with the outermost of weir surface portion of the structure surrounding each port 20, with some allowance for cresting of the liquid discharging from the ports 20.

The e line is adjustable by adjusting the level of the ports 20. This is commonly done by providing or substituting an end wall 22 having the ports 20 in the desired location. This adjustment is usually suited to the specific gravities of the materials comprising the feed mixture, the percentage of each in the feed, the inflow rate of the feed, and various other factors. In any event, the e line may be established by known procedures.

The baffle 62 extends outwardly beyond the layer of light phase material, i.e., the e line, in order to prevent the flow of light phase material from the zone 68 to zone 70. The baffle, being imperforate for the radial distance of the light phase layer, prevents its flow into the zone 70 while heavy phase material underflows the peripheral edge 72 of the baffle 62 through passageway 74 from separating zone 68 to discharging zone 70. The spacing between the peripheral edge 72 and the bowl 16 determines the flow area of the passageway 74. It should be large enough to prevent an excessive accumulation of heavy phase material in the separating zone 68.

As explained more fully in U.S. Pat. No. 3,795,361, the centrifugal force applied to the light and heavy phase materials in the separating zone 68 produces a centrifugal pressure head which is transmitted to the heavy phase material in the discharging zone 70. This pressure head, combined with the pressure applied by the screw conveyor 32, overcomes the centrifugal head of the heavy phase material in zone 70. The level of the heavy phase material in zone 70 is shown by a broken line identified by the letter x. The level designated x is slightly inward of the weir surfaces of the discharge ports 24, whereby heavy phase material is discharged from ports 24.

The feed cone 61 is disposed between discharge ports 24 and the path traveled by feed entering the separating zone 68. This, together with the baffle 62, keeps the feed out of the discharging zone 70. Preferably, the feed passages 54 are disposed radially inward of the feed cone 61, for directing feed onto the inner surface of the feed cone intermediate the ends thereof. Feed travels outwardly and axially along the inner surface of the feed cone 61, and joins the separated materials in the separating zone 68 where it also undergoes separation. It is noteworthy that the large open end 75 of the feed cone 61 extends outwardly to the maximum level a of the materials in the separating zone 68, with the inner surface of the feed cone terminating at about the level of the weir surfaces of the discharge ports 20. This arrangement avoids any splashing introduction of feed which might create turbulence and tend to re-mix separated materials of similar specific gravity.

The inner surface of the feed cone 61 may be provided with annularly spaced accelerator vanes 76 which extend in generally axial direction. When used, it is the function of the vanes 76 to assist in accelerating incoming feed until it approaches the angular velocity of the separated layers already in the zone 68. This also may minimize turbulence in the separating zone and improve clarification.

As best seen in FIG. 1, the feed cone 61 is rigidly secured to the hub 46, and the baffle 62 is rigidly secured to the feed cone 61, all in coaxial relationship. Furthermore, the conical helical flights 52 meet the cylindrical helical flights 50 at the feed cone 61, with one of the conical flights 52 being coiled about, and welded to, the feed cone 61 and the baffle 62. With this arrangement, the structural integrity of the conveyor 32 is ensured.

ADVANTAGES OF THE INVENTION

The feed cone 61 and baffle 62 combination of the present invention is an improvement upon the prior art in that the advantages of a conical feed cone are obtained without the disadvantages of conical baffle. For example, the feed cone 61 of the present invention is not creating turbulence.

Moreover, the advantages of a flat annular baffle are obtained without disadvantages. For example, the baffle 62 of the present invention is of simple construction as compared to a conical baffle, and its periphery is easily machined to the desired outside diameter. In addition, the discharging zone 70 is unobstructed and unconfined when compared to a centrifuge having a conical baffle whereby there is minimum impedance to the flow of discharging heavy phase material after it has passed through the passageway 74.

MODIFICATION

Figure 2:
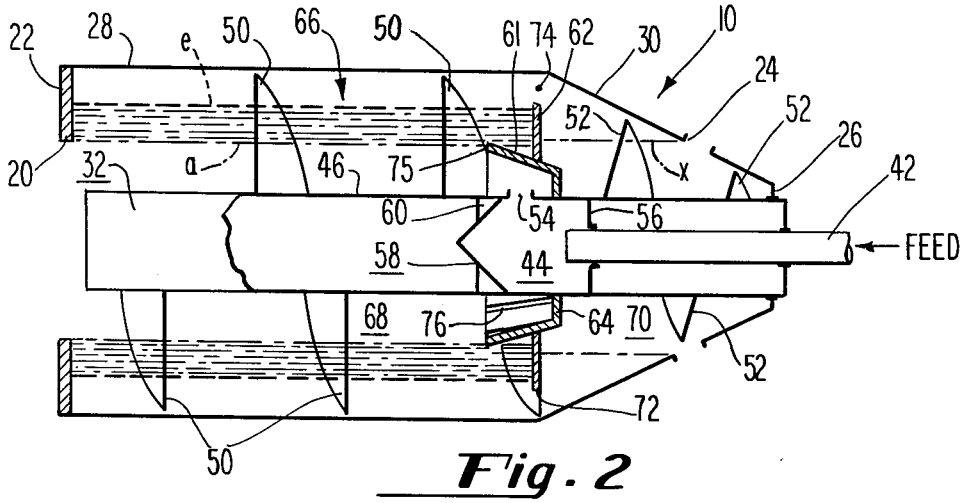
FIG. 2 is a schematic illustration of a centrifuge embodying the invention.
Figure 4:
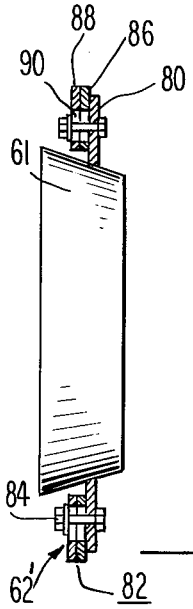
FIG. 4 is an enlarged view, partly in elevation and partly in section, of a portion of the screw conveyor of FIG. 1 in modified form, with the hub and screw flights omitted for clarity.
Figure 5:
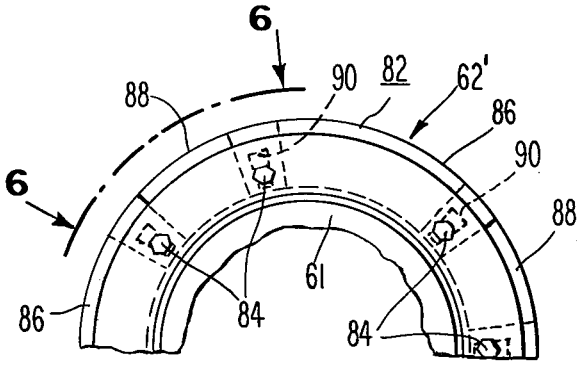
FIG. 5 is a fragmentary view in axial direction of the portion of the screw conveyor shown in FIG. 4.
Figure 6:
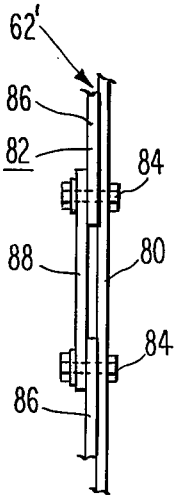
FIG. 6 is a developed view looking radially inwardly in the direction of the arrows 6—6 in FIG. 5 and showing a portion of the screw conveyor in detail.

As shown in FIGS. 4 to 6, the baffle 62 of FIGS. 1 to 3 may be modified by substituting an adjustable annular baffle 62'. The adjustable baffle 62' comprises a fixed annular base 80 and a movable ring 82, adjustably secured to the base 80 by a plurality of assemblies 84. As shown, each assembly 84 includes a conventional nut, bolt and lock washer.

The base 80 of baffle 62' extends in radial direction for about 80% of the full radial height of the baffle 62 shown in FIG. 1, and it is welded along its entire circumference to the exterior surface of the feed cone 61. At spaced intervals, axially extending holes are formed in the base 80 for the reception of the bolts which are part of the assemblies 84.

The movable ring 82 is comprised of about eight plates 86,88 of arcuate configuration arranged in series to encircle the feed cone 61, with the ends of adjacent plates in overlapping relationship. The plates on ring 82 are alternately long plates 86 and short plates 88, as best seen in FIG. 5.

A slot 90, which tapers in radially inward direction, is formed in the overlapping end portions of each adjacent pair of plates 86,88. Each slot 90 receives one of the bolts extending through the base 80, to facilitate the securing of the ring 82 to be moved outwardly, for example, on an enlarged circumference in which there is less overlap of adjacent plates 86,88. Likewise, if it is desired to provide a baffle 62' having a smaller diameter, it is only necessary to loosen the assemblies 84, slide the ring 82 inwardly so that adjacent plates 86, 88 have increased overlap, and then retighten the assemblies 84.

The modified baffle 62' of the present invention has all of the advantages of the baffle 62 plus adjustability of its outside diameter. Such adjustability is highly useful, together with provision for adjusting the weir level of the liquid discharge port 20, for obtaining optimum separation efficiency and optimum dryness of heavy phase cake when there are changes in the feed flow rate or in the concentration of solids in the feed.

What is claimed is:

1. Decanter centrifuge for separately discharging light and heavy phase materials from a mixture thereof, comprising a rotating, imperforate, cylindrical centrifuge bowl having one end thereof conically tapered, discharge ports for light phase material at the end wall of said cylindrical portion, and discharge ports for heavy phase material at the conical portion, the weir surfaces of the discharge ports for the light phase material having a shorter radial distance from the rotational axis of said bowl than the weir surfaces of the discharge ports for said heavy phase material, further comprising a screw conveyor coaxially mounted within the bowl for rotation relative thereto, the helical flights of the screw conveyor mounted coaxially with a feed cone and an annular baffle on a hub, with said feed cone being disposed radially outward of an outlet in the hub for the mixture, said helical flights being adapted to the contour of said bowl, with cylindrical and conical portions of the flights extending to the inner surface of corresponding cylindrical and conical portions of the bowl, thereby forming a chamber for said mixture helically wound around the rotational axis within the bowl, said chamber including a cylindrical separating zone and a conical discharge zone on opposite sides of said baffle, the outer edge of said baffle being spaced from the inner surface of said bowl to provide a restricted passageway between the separating zone and the discharge zone, characterized in, that said annular baffle is rigidly mounted on the outer surface of said feed cone in a position normal to said axis, and that the radial distance from said axis to the larger end of said feed cone is about equal to the radial distance from said axis to the weir surface of the discharge ports for the light phase material.

2. Decanter centrifuge apparatus according to claim 1 wherein the larger end of the feed cone is open and faces the discharge ports for light phase material with the baffle extending outwardly from said feed cone and terminating a smaller distance from said axis than the adjacent helical flight, and a greater distance from said axis than the larger end of the feed cone, along radial lines.

3. Decanter centrifuge apparatus according to claim 2 wherein the outside diameter of said baffle is in the range of between 70 and 95 percent of the outside diameter of the helical flight adjacent to the larger end of said feed cone.

4. Decanter centrifuge apparatus according to claim 3 wherein the periphery of the baffle is outward of the interface between separated light and heavy phase material in the separating zone.

5. Decanter centrifuge apparatus according to claim 1 wherein said baffle is removably mounted on said feed cone.

6. Decanter centrifuge apparatus according to claim 1 wherein said baffle is adjustably positionable on said feed cone a selected distance from said axis in a plane normal to said axis.

7. Decanter centrifuge apparatus according to claim 1 wherein said baffle is located adjacent to the junction of the cylindrical and conical portions of the bowl.

8. Decanter centrifuge apparatus according to claim 1 wherein said annular baffle is adjustably secured to said feed cone for varying its outside diameter.

9. Decanter centrifuge apparatus according to claim 8 wherein said annular baffle includes a fixed annular member secured to said feed cone, a ring adjustably secured to said annular member, and means securing said ring to said annular member, said ring comprising a plurality of arcuate plates with the adjacent ends of such arcuate plates being in overlapping relationship, said securing means including an inwardly tapering radial slot in the overlapping end portions of said arcuate plates.

10. Decanter centrifuge apparatus according to claim 1 wherein feed accelerating vanes extending in generally axial direction are provided on the inner surface of said feed cone.

* * * * *